United States Patent [19]

Weyrich

[11] 4,349,187

[45] Sep. 14, 1982

[54] SHEET FEEDER WITH NONSTOP DEVICE

[75] Inventor: Klaus Weyrich, Augsburg, Fed. Rep. of Germany

[73] Assignee: Georg Spiess, Gersthofen, Fed. Rep. of Germany

[21] Appl. No.: 130,248

[22] Filed: Mar. 14, 1980

[30] Foreign Application Priority Data

Mar. 26, 1979 [DE] Fed. Rep. of Germany ..... 2911735

[51] Int. Cl.[3] ..... B65H 1/26

[52] U.S. Cl. ..... 271/159; 271/164; 271/171; 414/118; 414/900

[58] Field of Search ..... 271/159, 158, 157, 164, 271/162, 171; 414/118, 119, 900

[56] References Cited

U.S. PATENT DOCUMENTS

| | | | |
|---|---|---|---|
| 1,948,001 | 2/1934 | Mensman et al. | 271/164 |
| 3,035,835 | 5/1962 | Reif et al. | 271/159 |
| 4,021,710 | 5/1977 | Fichte et al. | 271/159 X |
| 4,174,831 | 11/1979 | Marass et al. | 271/159 |
| 4,245,830 | 1/1981 | Fichte et al. | 271/164 |

FOREIGN PATENT DOCUMENTS

| | | | |
|---|---|---|---|
| 131549 | 7/1978 | German Democratic Rep. | 271/164 |

*Primary Examiner*—Bruce H. Stoner, Jr.
*Attorney, Agent, or Firm*—Max Fogiel

[57] ABSTRACT

In order to design a sheet feeder with a nonstop-device with stringers suspended at lifting chains and cross bars carried by the stringers for supporting bars that serve as base for a remaining pile, in such a way that the remaining pile, which is on the bars of the nonstop-device, is laterally adjustable, the stringers are seated in longitudinal guideways, extending in direction of lifting, and the cross bars are supported slidable on the stringers transversely to the direction of transport of the sheets and are traversed by means of a motor that is supported transversely to the direction of transport of the sheets, which motor can be actuated in the one or the other direction according to the situation of the side edge of the pile by means of a sensing device that senses at least one upper side edge of the pile. The sensing device may preferably at the same time be co-ordinated to a second motor for straightening the main pile.

21 Claims, 6 Drawing Figures

III
III
8
10
11
12
13
14
16
17
19
21
22
23
24
26
27
28
29

SHEET FEEDER WITH NONSTOP DEVICE

BACKGROUND OF THE INVENTION

This invention relates to a sheet feeder with a nonstop-device with stringers, suspended at lifting chains, and, carried by the stringers, cross bars that serve as support for bars that form the base for a remaining pile.

Arrangements of this kind ensure a continuous feeding, and have therefore proved satisfactory. It has, however, in many cases turned out to be unfavorable that the remaining pile on the bars cannot be adjusted transversely to the direction of transport of the sheets. Therefore displacements in the area of the side edges of the pile cannot be adjusted and due to this, inaccuracy is to be expected in the area of the side stop. There are certainly sheets feeders already known with which the main pile may be adjusted laterally in order to avoid the above mentioned difficulties. To do so, the platform that receives the pile is supported slidable, transversely to the direction of transport of the sheets, and can be adjusted by means of a motor. The motor can be actuacted by means of a sensing device that senses the side edges of the pile. Up to now, there has been no example for the lateral adjustment of the remaining pile which is on the bars of the nonstop-device.

SUMMARY OF THE INVENTION

Proceeding from here, it is therefore, the problem of the present invention, to design a sheet feeder with a nonstop-device as mentioned at the beginning in such a way, that the remaining pile, which is on the bars of the nonstop-device, can be adjusted laterally, thereby allowing an exact lateral adjustment of the sheets, even in case of nonstop operation.

The problem is solved, according to the present invention, in a surprisingly simple way by the fact that the stringers are seated in longitudinal guideways that extend in the direction of lifting and that the cross bars are supported on the stringers transversely adjustable to the direction of transport of the sheets; the cross bars can be traversed by means of a motor, supported transversely to the direction of transport of the sheets, that can be actuated to the one or the other direction according to the situation of the side edges of the pile by means of a sensing device that senses at least one upper edge of the pile.

These measures prove in an advantageous manner most simple and can be realized without any considerable operations in already existing constructions of so-called nonstop-devices.

The basic design of nonstop-devices that have proved useful can therefore be kept in an advantageous manner. The additional constructional expenditure caused by the application of the measures according to the invention therefore proves to be most insignificant and is by far compensated for by the advantages, especially with regard to the easy and trouble-free operation. With the present invention an exact adjustment of the side of the pile, even in case of nonstop-operation, is possible and due to this, practically can be guaranteed until the very last sheet is being worked for the first time.

In case of sheet feeders, for which at the same time a device for the automatic adjustment of the sides of the main pile is provided, the base of the main pile being laterally slidable and also being laterally adjustable by means of a sensor-controlled motor, the sensing device may expediently be co-ordinated to both motors, a fact that cannot only prove most simple and cost-saving, but also most space-saving.

Further advantages and suitable developments of the generic measures will result from the description of an embodiment, as mentioned below, on the basis of the drawing.

DESCRIPTION OF THE PREFERRED EMBODIMENTS

Figure 1:
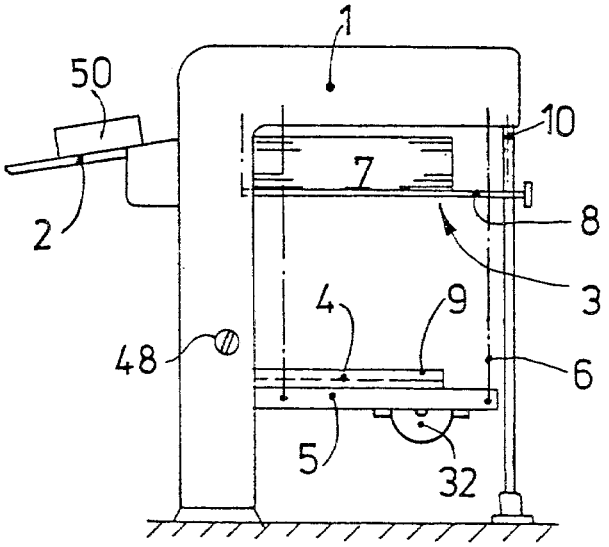
FIG. 1 shows a diagrammatic view of a feeder with nonstop-device.

The feeder, shown in FIG. 1 and indicated as a complete unit by reference numeral 1, is to be coupled with a subsequently arranged sheet working machine, not described in detail here, via a feed plate 2. The feeder is equipped with a nonstop-device, indicated as a complete unit 3, which is to guarantee continuous operation even when a pile of sheets is changed. At first, a sheet pile to be worked is located on the pile table 4, which is housed in the illustrated embodiment by a supporting frame that is suspended by lifting chains 6. As soon as the pile is reduced to a height of approximately 50 cm, it is taken over by the nonstop-device 3. This remaining pile, as indicated by reference numeral 7, is carried on bars 8 which can be pushed from behind into corresponding grooves 9 of the pile table 4 during normal operation. The nonstop-device 3 is equipped with lifting chains 10. While the remaining pile 7 is lifted in cycles by these lifting chains 10, as it is being used up, the pile table 4 can be lowered in order to put a new pile onto it.

Figures 2A, 2B:
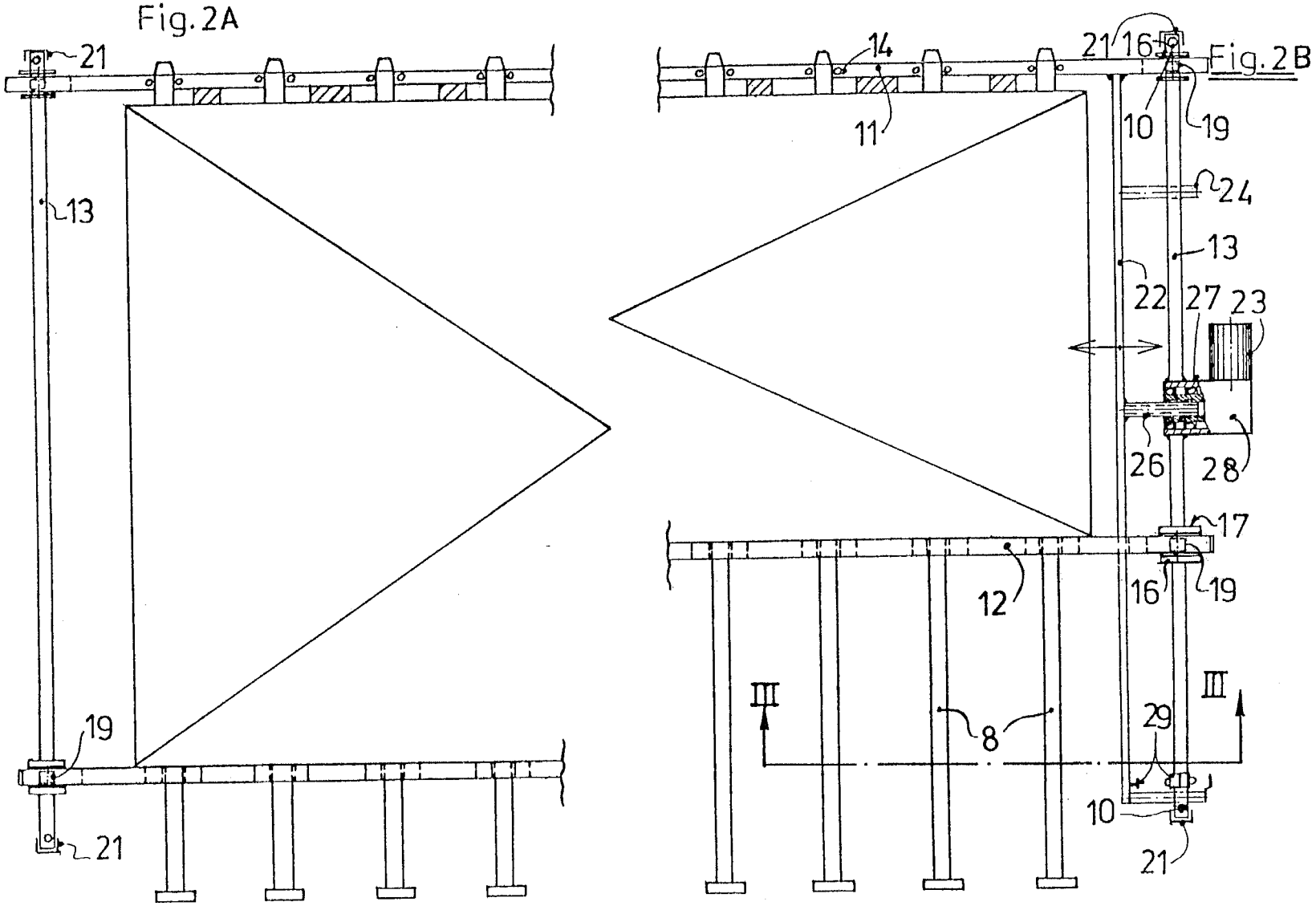
FIG. 2A shows a top view of the nonstop device in one position.
FIG. 2B shows the device of FIG. 2A in another position.

In order to support the bars 8 that receive the remaining pile 7, a front cross bar 11 and a rear cross bar 12 are provided, as seen best in FIG. 2, which are in turn supported at their ends by lateral stringers 13, that are suspended at the chains 10. The front cross bar 11 is arranged in the area in front of the pile stop, formed by strips that are not indicated in detail. The rear cross bar 12 is suitably adjustable over the length of the stringers 13 and may therefore, as shown in FIG. 2, be adjusted to each pile rear edge, even if different sheet sizes are being worked. This results not only in a rear pile stop but also in a minimum free bending length of the bars 8. The bars 8 are simply supported on the front cross bar 11 in the illustrated embodiment. For lateral fixation, carriers may here be provided, formed by pins 14. The rear cross bar 12 is equipped at its bottom side with reception brackets 15 to receive the bars 8. This ensures that the rear cross bar 12 forms a rear pile stop; therefore no displacement of the pile can occur when the bars 8 are drawn out. The spacing of the brackets 15 and of the pins 14 must correspond exactly to the spacing of the grooves 9 of the pile table 4.

Figure 3:
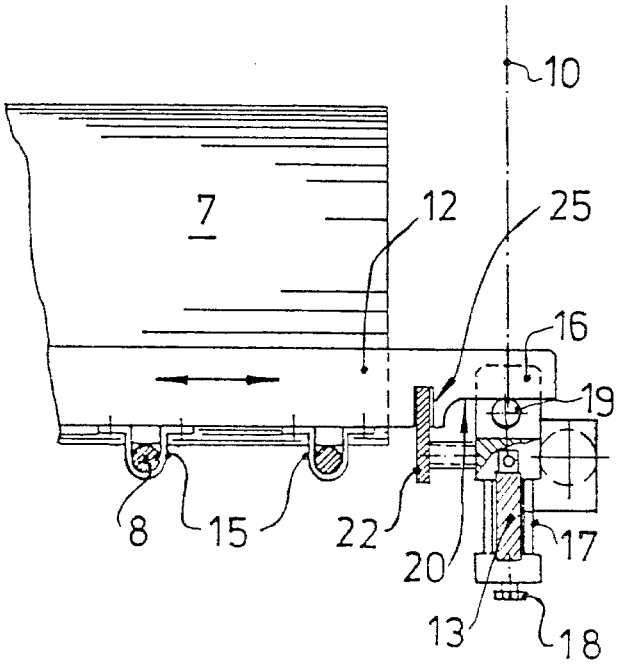
FIG. 3 shows a sectional view along the line III/III in FIG. 2.

In order to obtain the required adjustability of the pile side, the cross bars 11 and 12 are supported to be slidable transversely to the direction of transport of the sheets on the stringers 13. In the illustrated embodiment the ends of the cross bars 11 and 12 are inserted into grooves by guide jaws 16 that extend transversely to the direction of transport of the sheets. The guide jaws 16 which are co-ordinated to the stationary front cross bar 11, may each be fixed directly at the stringers 13. The guide jaws 16 which are co-ordinated to the adjustable rear cross bar 12, are expediently components of guide shoes 17 that are arranged adjustable on the stringers 13. The guide shoes 17 are capable of being clamped by means of clamping screws, indicated in FIG. 3 at 18. In the area between the guide jaws 16 belonging together, one or more carrying rollers 19 may be arranged, upon which the cross bars 11 and 12 are supported by bearing surfaces 20, provided at the ends. The stringers 13 are fixed parallel to the direction of transport of the sheets. To do so, the ends of the stringers 13 move in guideways 21 extending in the direction of lifting, which guideways are formed in the illustrated embodiment simply by rails having a U-shaped cross-section. The cross bars 11 and 12 may each be provided with a separate adjusting device. In the illustrated embodiment the cross bars 11 and 12 are linked together by means of a slide rail 22, arranged parallel to the stringers in order to accomplish a joint drive. The slide rail 22 is interlocked with a motor 23 that is co-ordinated to both cross bars. The slide rail 22 is supported slidable transversely to the direction of transport of the sheets at the adjoining stringer 13. To do so, the slide rail 22 in the illustrated embodiment is provided with two guide pins 24, arranged transversely to the direction of transport of the sheets, that engage in corresponding bores of the corresponding stringer 13, in this case of the right stringer. In the illustrated embodiment the slide rail 22 is simply welded to the front cross bar 11. In the area of rear cross bar 12, which is adjustable in the direction of transport of the sheets, simply a positive engagement is provided transversely to the direction of transport of the sheets. To do so, the rear cross bar 12 is provided with a continuous groove 25 extending in the direction of transport of the sheets, into which the slide rail 22 engages, as may best be seen in FIG. 3.

In case of arrangements with a rear cross bar that is stationary in direction of transport of the sheets, the slide rail 22 may simply be welded, bolted or similary secured at both sides. In the illustrated embodiment a simple flat iron billet is provided to form the slide rail 22. In many cases it may, however, prove expedient to provide an appropriate sectional steel bar or a framed beam to avoid bending.

The motor 23, provided for shifting the slide rail 22 and thereby the cross bars 11 and 12, is expediently fixed directly on stringer 13, adjoining the slide rail 22. The guideways 21 of the stringers ensure, due to the weight of the motor, that the respective stringer 13 may not be overturned. The motor 23 may be designed as an adjusting cylinder, the piston rod of which acts on the slide rail 22. In the illustrated embodiment the motor 23 is designed as an electric motor, which is coupled with the slide rail 22 via a spindle drive. To do so, a spindle 26 may be provided, fixed rigidly to the slide rail 22, that engages into a nut 27 which is rotated by the motor 23. This nut 27 forms in the illustrated embodiment the output of a gear 28, to which the motor 23 is placed in angular relationship in order to save space. The length of the cross bars 11 and 12 is of course to be designed in such a way that even in case of an adjustment to the utmost degree of the spindle 26, and the nut 27, a safe support in the area of all carrying rollers 19 is guaranteed. In order to switch off the motor 23 when the slide rail 22 has reached extreme positions, limit switches 29 may expediently be provided, which are actuated when the slide rail 22 moves onto the adjoining stringer 13, or when the rear ends of the guide pins 24 move in the corresponding stringer. It would of course be possible not to arrange the motor 23 with the drive 28 on one stringer 13, but to pilot it in a guide rail extending in the lifting direction.

The motor 23 can be actuated manually, as well as by means of a sensing device that will be described in detail below. Tests have shown that it is useful in starting the nonstop-device to set the slide rail 22, and thereby at least the cross bar 11, that is connected firmly with it, by controlling the motor 23 manually to the required position, in which the carriers 14 are aligned with the grooves 9 of the pile table 4. As soon as the lifting operation of the nonstop-device starts, the motor 23 is controlled by the sensing equipment, as described in the following, that senses the state of the pile side.

Figure 4:
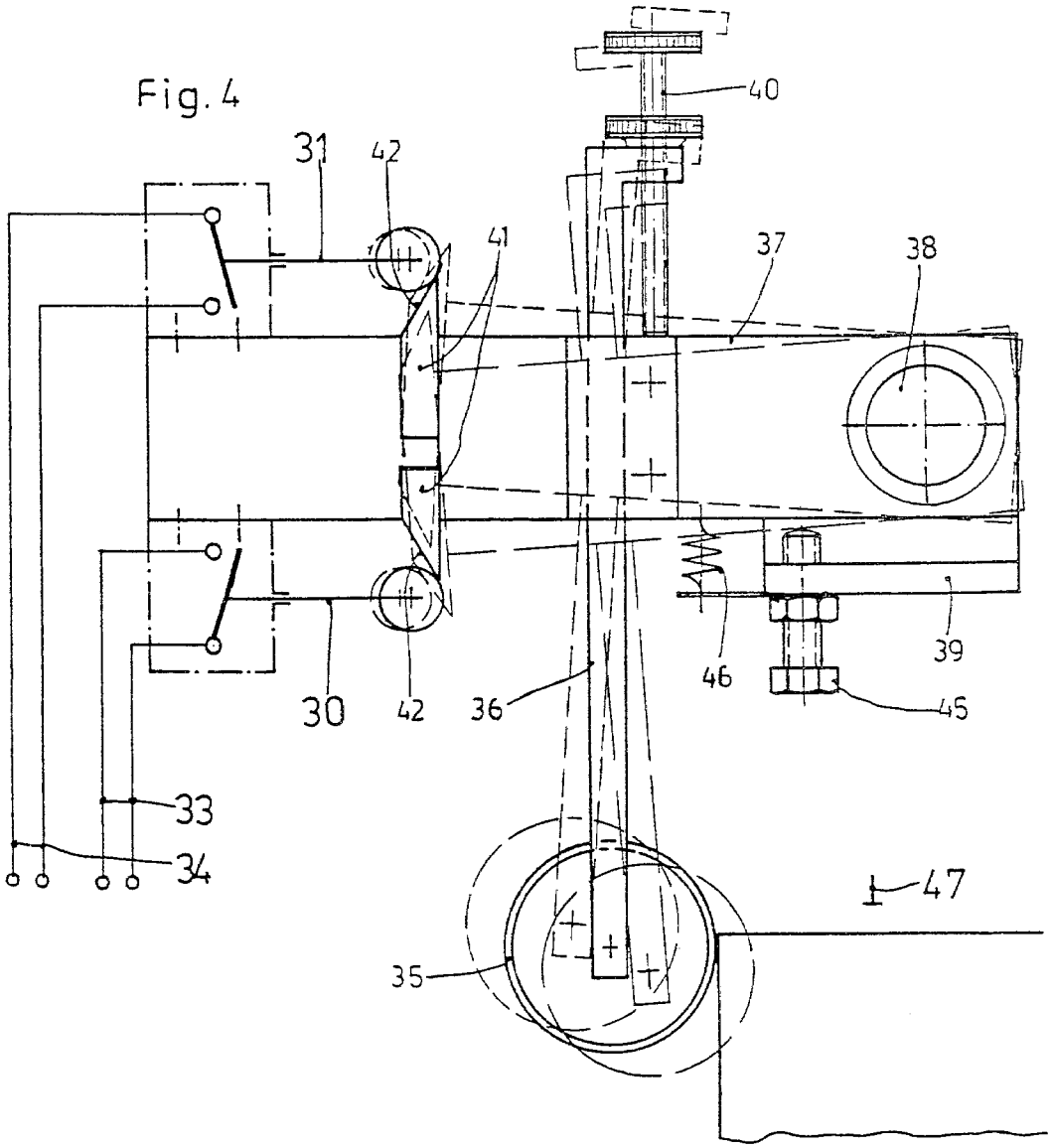
FIG. 4 shows an elevational view of a preferred embodiment of the sensing device.

The sensing equipment has, as is shown clearly in FIG. 4, a sensing roller 35 that is in contact with one side edge of the pile. The deflections of the sensing roller, caused by displacements of the pile side edge, are transmitted to two switches 30 and 31, that actuate the motor 23 in one or the other direction by means of, e.g. control contactors. In the illustrated embodiment the pile table 4 shall be laterally adjustable to the supporting frame 5 in order to accomplish a lateral straightening of the main pile. To do so, a sensor-controlled motor is provided, arranged on the supporting frame 5, as indicated in FIG. 1 at 32. In doing so, the sensing device, as shown in FIG. 4, may expediently be co-ordinated to both the motors 23 and 32. Switching may expediently be carried out by means of the nonstop-selector switch 48 by means of which the lifting device of the nonstop-device is started and the main lifting-device is switched off. The electric circuits 33 and 34 connected to the switches 30 and 31, are in this case to be simply run via the nonstop-selector switch (known-per-se) that is not described in detail here. This measure guarantees an automatic continuous straightening of the pile side in case of switching to nonstop operation.

The sensing roller 35 is connected to a pivoted lever 27 by means of a roller carrier 36. The pivoted lever extends approximately vertically to the roller carrier 36, as may be seen in FIG. 4. The fulcrum of the pivoted lever 37 is within the base surface of the pile. For the reception of the pivoted lever 37 a cross bar 38 is provided, extending in feed direction at least in the bearing area, being within the base surface of the sheet pile. The pivoted lever 37 is pivotally mounted on the cross bar 38. The cross bar 38 may be seated in support fish-plates 39, which are expediently mounted at the machine frame and transversely adjustable to the direction of transport of the sheets in order to accomplish a lateral adjustability of the pivoted lever 37 and thereby of the sensing roller 35. The roller carrier 36 may be connected rigidly with the pivoted lever 37. In the represented embodiment the roller carrier 36 is supported axially adjustable at the pivoted lever 37 in order to accomplish an adjustability in height of the sensing roller 35. In order to accomplish a fine adjustment, an adjusting screw 40 is provided which results in a bending movement of the roller carrier 36 and is supported at the face ends at the pivoted lever 37. At the end, opposite to the point of support, projecting above the reception of the roller carrier 36, of the pivoted lever 37 that extends approximately horizontally when in zero position, working faces are provided, by means of which, when deflected from zero position, the pivoted lever 37 actuates the switches 30 and 31, which may here be designed simply as pressure switches. To form these working faces the illustrated embodiment is provided with fish-plates 41 mounted at the face end on the pivoted lever 37, each showing a working face formed by one face 42. The fish-plates 41 are expediently adjustable. Instead of two fish-plates, as in the illustrated embodiment, only one fish-plate could be provided which can be brought to engage with the switches 30 respectively 31 in the area of two edges that are preferably parallel. It is also possible not to mount the fish-plate or the fish-plates at the face end on the pivoted lever 37, but to arrange these in the area of the longitudinal side of the pivoted lever 37. In that case the direction of operation of the switches 30 and 31 is approximately parallel to the side edge of the pile.

Figure 5:
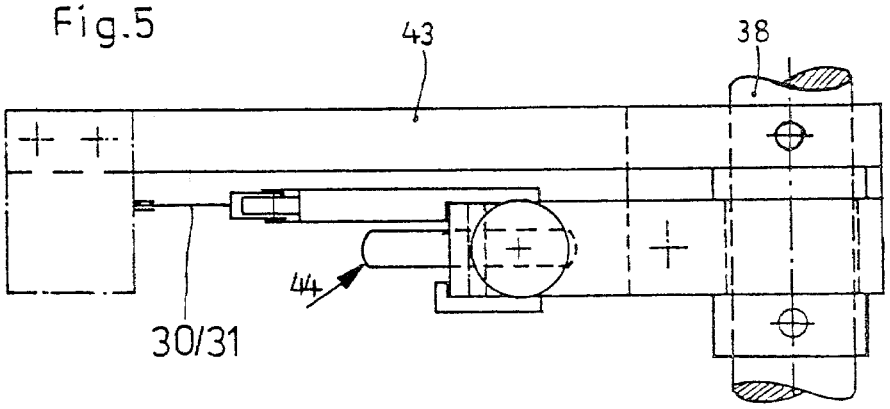
FIG. 5 shows a top view of the preferred embodiment.

The switches 30 and 31 are, as may best be seen from the top view of FIG. 5, expediently mounted on a holder 43 extending approximately parallel to the pivoted lever 37. The holder 43 is fixed in a torsionproof manner on the cross bar 38. The sensing roller 35 may be convex in the area of its circumference, as indicated at 44, due to which a pointlike tracing can be accomplished. In the illustrated embodiment the diameter of the sensing roller 35 is about 30 mm whereas this roller diameter may be in the range between 20 and 50 mm. Due to this, a certain inertia in tracing occurs in an advantageous manner, the accuracy being, however, sufficient. When thin paper is being worked, the use of sensing rollers with a smaller diameter may prove favorable. When thick paper is being worked, sensing rollers with a larger diameter may be used. For the limitation of the maximum deflection of the pivoted lever 37 stop screws have been provided of the kind as indicated at 45. In order to accomplish a full contact of the roller at the corresponding side edge of the pile, a spring 46 is provided which acts at the pivoted lever 37.

Due to the fact that here the sensing devices can swing to both sides with reference to their rest position and that a switch is co-ordinated to each direction of swinging, it is most advantageous that one sensing device is sufficient. At the same time the sensing roller 35 can detect displacements in different directions in the area of the side edge of the pile, whereby the conditions in the area of the opposite side edge of the pile are advantageously not taken into account. The main thing is, as is well known, to straighten only one side edge of the sheets accurately, that is that side edge of the sheet which is near the side mark. The sensing device that senses the side edge of the pile, as shown in FIG. 4, is therefore expediently arranged in the area of the pile side co-ordinated to the sheet side stop 50.

In order to actuate the switches 30 and 31 when the first sheet pile is lifted up into working position by means of the main lifting device, a sensor 47 may expediently be provided, as is indicated schematically in FIG. 4, that may be operated by the upper edge of the pile. The electric circuits 33 and 34 are connected with this sensor. The sensor 47 is approximately at the working height of the suction head which is not shown in detail. The sensor 47 is expediently designed as a tumbler switch, that moves automatically when the upper edge of the pile moves up, into a position in which the electric circuits 33 respectively 34 are closed and the contact with the upper edge of the pile is interrupted, so that no difficulties will arise when the topmost sheet is taken away.

While the invention has been illustrated by way of an exemplary embodiment, it is capable of a variety of modifications which will or may offer themselves to persons skilled in the art, and all such modifications are therefore intended to be embraced within the scope of the appended claims.

I claim:

1. In a sheet pile feeder with a nonstop device for supporting and lifting a partial remaining pile while the feeder receives a fresh new pile for feeding, a combination comprising: guideways elongated in the direction of pile lifting; stringers movable in said guideways; cross bars carried by said stringers and adapted to support a partial pile to be lifted; means mounting said cross bars for sliding movement transversely to the direction of withdrawal of sheets from the partial pile; a direction-reversible motor operatively connected with said cross bars to move the same transversely in one or in an opposite direction; and means for sensing at least one upper side edge of the partial pile and connected with said motor to make the same operate in one or in another direction depending upon sensed conditions, said partial remaining pile being laterally adjustable for adjusting sheets laterally in nonstop operation; said sensing means comprising further at least one sensing device for effecting automatic straightening of the side positions of the new pile and the partial pile; a receiver for the new pile and being laterally slidable by means of an associated motor, said sensing device being coordinated with both of said motors; and a selector switch for selecting operation of said nonstop device and serving to couple said sensing device alternatively to one or the other of said motors.

2. The combination defined in claim 1; and further comprising lifting chains suspending said stringers.

3. The combination defined in claim 1, wherein said motor is rigidly mounted on one of said stringers.

4. The combination defined in claim 1; and further comprising a slide rail coupled with said motor and extending parallel to at least one of said stringers and connecting said cross bars to each other.

5. The combination defined in claim 4, wherein said slide rail is guided at the adjoining stringer in the direction of setting.

6. The combination defined in claim 4; and further comprising a screw spindle rigidly fixed to said slide rail, and a threaded nut rotatably connected with said motor and meshing with said screw spindle.

7. The combination defined in claim 4, said cross bars including a front cross bar mounted rigidly at said slide rail, and a rear cross bar which is mounted at said slide rail for slidable displacement in the direction of sheet withdrawal.

8. The combination defined in claim 7, said rear cross bar having a groove engageable with said slide rail and extending throughout in the direction of sheet withdrawal.

9. The combination defined in claim 1, said cross bars being adjustable transversely to the direction of sheet transport; and further comprising limit switches coupled with said motor and operative for limiting the distance of adjustability of said cross bars transversely to the direction of sheet transport.

10. The combination defined in claim 1, further comprising carrier rollers on which said cross bars move, said rollers being arranged at the side of the stringers and said cross bars having roller-engaging bearing surfaces at their ends.

11. The combination defined in claim 1, said cross bars having pin and bracket means for connecting to supporting bars carrying a pile to move said supporting bars along with said cross bars when said cross bars cross the sheet transport direction.

12. The combination defined in claim 1, wherein said guideways are constituted by rails of U-shaped cross section and which cover the ends of said stringers.

13. The combination defined in claim 1, said sensing device having a sensor at only one side of said partial pile and including a sensing roller cooperating with said one side.

14. The combination defined in claim 13, wherein said one side is the pile side at which a sheet side stop is located.

15. The combination defined in claim 13; further comprising a pivoted lever carrying said sensing roller and being pivotably mounted at one of said cross bars which extends in sheet withdrawal direction, said lever having an end cooperating with two switches each of which is coordinated to one movement direction of said motor.

16. The combination defined in claim 15, wherein said two switches are pressure-operated switches.

17. The combination defined in claim 15, wherein said switches can be respectively operated when one pile is lifted to working position and are actuated by a top sensor operable by a top edge of the pile when the top edge reaches the area of the working height of the sheet-removing suction head.

18. The combination defined in claim 15; further comprising a rod-shaped roller carrier supporting said sensing roller and extending approximately at a right angle to said pivoted lever.

19. The combination defined in claim 13, wherein said sensing roller has a diameter in the range between substantially 20 and 50 mm.

20. The combination defined in claim 19, wherein said diameter is substantially 30 mm.

21. The combination defined in claim 13, wherein said sensing roller is convex in the area of its circumference.

* * * * *